US009196417B2

(12) United States Patent
Jitaru et al.

(10) Patent No.: US 9,196,417 B2
(45) Date of Patent: Nov. 24, 2015

(54) MAGNETIC CONFIGURATION FOR HIGH EFFICIENCY POWER PROCESSING

(71) Applicant: DET International Holding Limited, Grand Cayman (KY)

(72) Inventors: Ionel Jitaru, Tucson, AZ (US); Marco Antonio Davila, Tucson, AZ (US); Andrei Savu, Bucharest (RO); Andrei Ion Radulescu, Targoviste (RO)

(73) Assignee: DET International Holding Limited, Grand Cayman (KY)

( * ) Notice: Subject to any disclaimer, the term of this patent is extended or adjusted under 35 U.S.C. 154(b) by 0 days.

(21) Appl. No.: 13/887,346

(22) Filed: May 5, 2013

(65) Prior Publication Data

US 2013/0314197 A1 Nov. 28, 2013

Related U.S. Application Data

(60) Provisional application No. 61/642,804, filed on May 4, 2012.

(51) Int. Cl.

| | |
|---|---|
| ***H01F 17/04*** | (2006.01) |
| ***H01F 27/24*** | (2006.01) |
| ***H01F 27/28*** | (2006.01) |
| ***H01F 27/34*** | (2006.01) |
| ***H01F 38/14*** | (2006.01) |

(52) U.S. Cl.

CPC ..... *H01F 27/346* (2013.01); *H01F 27/24* (2013.01); *H01F 38/14* (2013.01)

(58) Field of Classification Search

CPC ..... H01F 3/10; H01F 27/24; H01F 3/14; H01F 27/346; H01F 2027/348; H01F 27/385; H01F 17/045; H02M 1/40; H02M 2001/0064; H04B 5/0037

USPC ..... 336/105, 177, 178, 212, 221, 214, 215, 336/222; 29/602.1

See application file for complete search history.

(56) References Cited

U.S. PATENT DOCUMENTS

| | | | | |
|---|---|---|---|---|
| 1,876,451 | A | 9/1932 | Gurtler | |
| 2,976,605 | A * | 3/1961 | Lemaire | 29/609 |

(Continued)

FOREIGN PATENT DOCUMENTS

| | | | |
|---|---|---|---|
| DE | 10112892 | A2 | 10/2002 |
| EP | 0507360 | A2 | 10/1992 |

(Continued)

OTHER PUBLICATIONS

European Patent Office Search Report, Mar. 23, 2015, 10 pages, Application No. EP 13405056.6.

(Continued)

*Primary Examiner* — Elvin G Enad
*Assistant Examiner* — Joselito Baisa
(74) *Attorney, Agent, or Firm* — Vector IP Law Group; Robert S. Babayi

(57) ABSTRACT

Several new and useful features for a magnetic structure are provided. One feature is that the magnetic structures are configured to help minimize the winding's AC losses, improving the system's efficiency. Another feature is that the combination of different magnetic hats creates a shaping path for the magnetic field. Still another feature is that a magnetic hat concept can be applied to a variety of magnetic core shapes.

16 Claims, 14 Drawing Sheets

(56) References Cited

U.S. PATENT DOCUMENTS

| | | | | |
|---|---|---|---|---|
| 4,075,591 | A * | 2/1978 | Haas | 336/200 |
| 4,301,404 | A | 11/1981 | Ley | |
| 5,808,537 | A * | 9/1998 | Kondo et al. | 336/233 |
| 6,857,321 | B2 * | 2/2005 | Chang | 73/779 |
| 6,879,237 | B1 * | 4/2005 | Viarouge et al. | 336/229 |
| 7,443,277 | B2 * | 10/2008 | Yamaguchi | 336/208 |
| 7,675,714 | B1 * | 3/2010 | Yucesan et al. | 360/265.8 |
| 7,701,317 | B2 * | 4/2010 | Sullivan et al. | 336/178 |
| 7,741,942 | B2 * | 6/2010 | Sano | 336/84 M |
| 7,849,586 | B2 * | 12/2010 | Sutardja | 29/604 |
| 7,893,807 | B2 * | 2/2011 | Sano | 336/212 |
| 8,299,885 | B2 * | 10/2012 | Ikriannikov et al. | 336/212 |
| 2004/0119576 | A1 | 6/2004 | Nakao | |
| 2004/0232845 | A1 | 11/2004 | Baarman | |
| 2005/0140482 | A1 | 6/2005 | Cheng | |
| 2010/0308939 | A1 | 12/2010 | Kurs | |

FOREIGN PATENT DOCUMENTS

| | | | |
|---|---|---|---|
| EP | 1011187 | A1 | 6/2000 |
| EP | 1634366 | A1 | 3/2006 |
| EP | 2172952 | A1 | 4/2010 |
| EP | 2196351 | A1 | 6/2010 |
| GB | 2458476 | A | 9/2009 |
| JP | 2001076598 | A | 3/2001 |
| JP | 2009123727 | A | 6/2009 |
| JP | 2011142177 | A | 7/2011 |
| WO | 9948130 | A1 | 9/1999 |
| WO | 0116995 | A1 | 3/2001 |
| WO | 2008140333 | A2 | 11/2008 |
| WO | 2009111597 | A2 | 9/2009 |
| WO | 2010/090538 | A1 | 8/2010 |
| WO | 2010090538 | A1 | 8/2010 |
| WO | 2010090539 | A1 | 8/2010 |
| WO | 2011148289 | A2 | 12/2011 |
| WO | 2012008693 | A2 | 1/2012 |
| WO | 2012/018268 | A1 | 2/2012 |
| WO | 2012018268 | A1 | 2/2012 |

OTHER PUBLICATIONS

European Patent Office Search Report, Jun. 23, 2014, 8 pages, Application No. EP 13405055.8.

European Patent Office Search Report, Feb. 11, 2015, Application No. EP 13405054.1.

European Patent Office Search Report, Jan. 13, 2014, Application No. EP 13405057.4.

Fotopoulou K et al., "Wireless Powering of Implanted Sensors using RF Inductive Coupling",Sensors, 2006. 5th IEEE Conference on, IEEE, PI, Oct. 22, 2006, pp. 765-768.

Phadke A G et al., "A New Measurement Technique for Tracking Voltage Phasors, Local System Frequency, and Rate of Change of Frequency", IEEE Transactions on Power Apparatus and Systems, IEEE Inc. New York, US, vol. PAS-100, No. 5, May 1, 1983, pp. 1025-103.

Budhia M et al: "A new IPT magnetic coupler for electric vehicle charging systems", IECON 2010—36th Annual Conference on IEEE Industrial Electronics Society, IEEE, Nov. 7, 2010, pp. 2487-2492, NJ, USA.

Masato Chigira et al: "Small-size light-weight transformer with new core structure for contactless electric vehicle power transfer system", Energy Conversion Congress and Exposition (ECCE), 2011 IEEE, IEEE, Sep. 17, 2011, pp. 260-266.

European Patent Office Communication Pursuant to Article 94(3) EPC, Jul. 9, 2015, Application No. 13 405 058.2.

* cited by examiner

| Pad Topology | (a) | (b) | (c) | (d) | (e) |
|---|---|---|---|---|---|
| |  |  |  |  |  |
| $P_{in}$ at given Separation (VA) | 100mm 3841<br>150mm 1236<br>200mm 435 | 100mm 3832<br>150mm 1212<br>200mm 420 | 100mm 3479<br>150mm 1102<br>200mm 383 | 100mm 2825<br>150mm 868<br>200mm 293 | 100mm 2480<br>150mm 775<br>200mm 264 |
| No. of bars | 32.5 | 31.5 | 33 | 21 | 18 |
| Usc (VA/cm²) | 3.74 | 3.44 | 2.98 | 3.80 | 3.89 |

MAGNETIC CONFIGURATION FOR HIGH EFFICIENCY POWER PROCESSING

RELATED APPLICATION/CLAIM OF PRIORITY

This application is related to and claims priority from U.S. Provisional application Ser. No. 61/642,804, entitled Magnetic configuration for High Efficiency Power Processing, filed May 4, 2012, which provisional application is incorporated herein by reference.

Power transformers are a fundamental component of a power supply. The efficiency of the transformer has a great impact on the total power converter's efficiency.

The AC resistance of the winding is a significant factor of increasing the conduction losses in a transformer. Severe proximity effects increase the AC resistance. Also if the windings are in the path of the magnetic field, the AC loss increases due to the fact that the field lines cut into the copper creating eddy currents.

AC losses increase when the air gap in the transformer increases, and when the winding is closer to the air gap. This is due to the fact that the magnetic field lines become perpendicular to the windings. The windings can be planar, copper wire, litz wire, all can be affected by this phenomena.

In the case of wireless/contactless power supplies or inductive power transfer (IPT) the transformer's air gap increases automatically compared to the conventional transformers. The magnetic field lines become perpendicular to the windings creating unwanted proximity effects.

This application is accompanied by FIGS. 1-16 which are reproduced and described in the description that follows.

PRIOR ART

Figure 1:
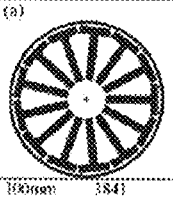
FIG. 1 shows an arrangement of proposed circular pads.
Figure 1:
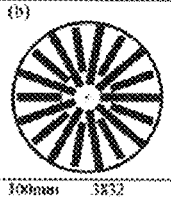
Figure 1:
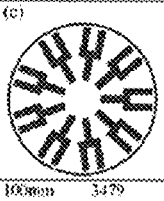
Figure 1:
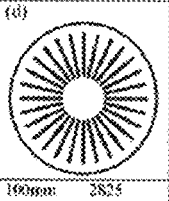
Figure 1:
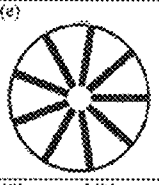

An investigation and analysis of circular pot cores is performed by John T. Boys and Grant A. Covic in [2]. In their work there is no consideration of AC losses in the transformers. FIG. 1 shows their arrangement of their proposed circular pads.

Figure 2:
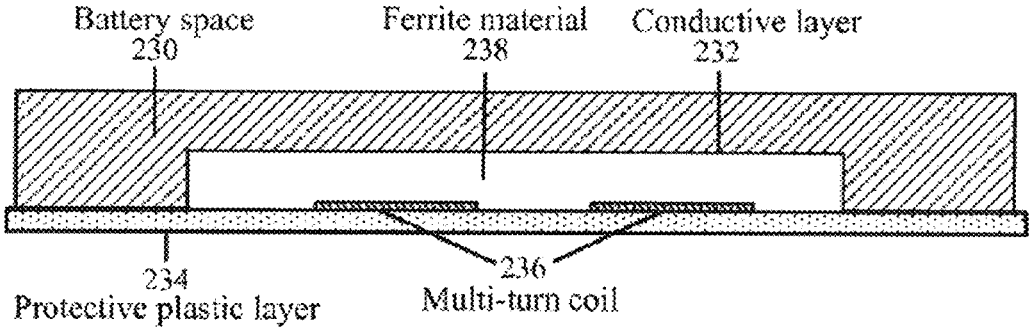
FIG. 2 shows an arrangement of material and winding in a circular pot core.

A method of transferring power at a large distance is claimed in [2]. FIG. 2 shows their arrangement of the magnetic material and winding. The core used is a circular pot core. The winding is a flat multi-turn coil. There is no mention about AC losses in the windings.

Figure 3:
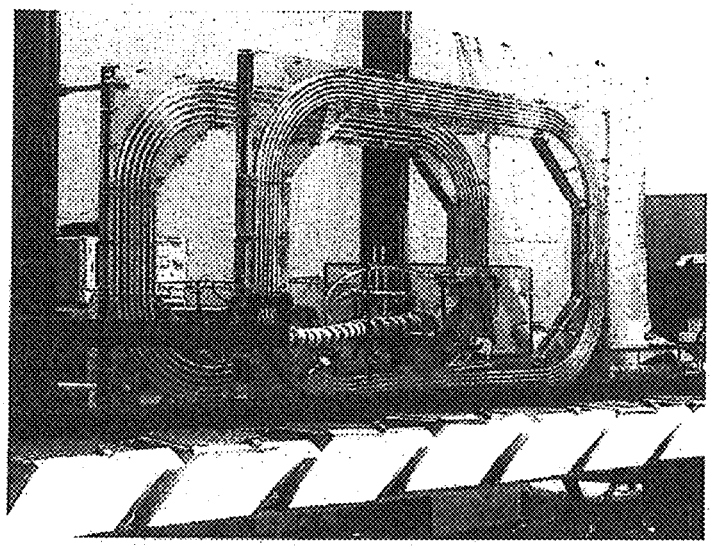
FIG. 3 shows a proposed transformer design, involving increasing DC distance of the windings.

Careless wireless power transfer systems are investigated by John M. Miller, Matthew B. Scudiere, John W. McKeever, Cliff White in [3]. Coreless systems have to be large in size due to the fact that the lack of the magnetic core decreases the inductance. In order to compensate from a practical point of view the inside area of the coils has to be increased, or the number of turns has to be increased. Both solutions increase the DC resistance of the windings and as a result they increase the AC resistance of the windings. FIG. 3 shows the proposed transformer design from [3].

In [3] the authors acknowledge the fact that winding's AC losses play a significant role in the system's efficiency but they do not provide a solution to the problem.

Figure 4:
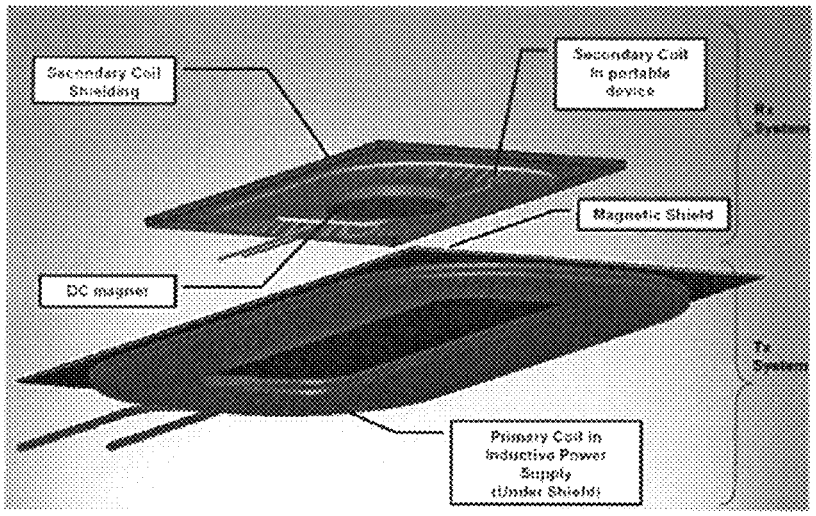
FIG. 4 shows a concept for low power wireless power systems.

Low power wireless power systems described in [4] use a ferrite material underneath the primary and secondary windings which increases the transformer's coupling. The use of a magnetic material also has the role of shielding the back side of the windings from the magnetic field. FIG. 4 shows the concept presented in [4]. Also in [4] the authors propose the use of a permanent magnet in the center of the winding in order to increase the coupling coefficient. The AC losses are not taken into consideration.

DESCRIPTION OF THE PRESENT INVENTION

First Embodiment

Figure 5:
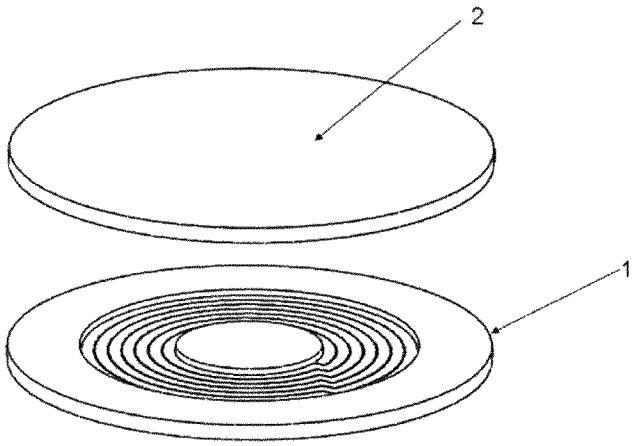
FIG. 5 shows a first magnetic structure according to the present invention.

FIG. 5 shows a first magnetic structure according to the present invention. It comprises of a primary side 1 and a secondary side 2 which are identical in form and size. The primary and secondary include magnetic material and conductive windings. The windings can be made of regular copper wire or litz wire or they can be planar. Also the shape of the wire can be circular or rectangular. In the case of the planar winding configuration, the planar winding width can be designed with constant width per each turn or with a variable width per each turn.

Figure 6:
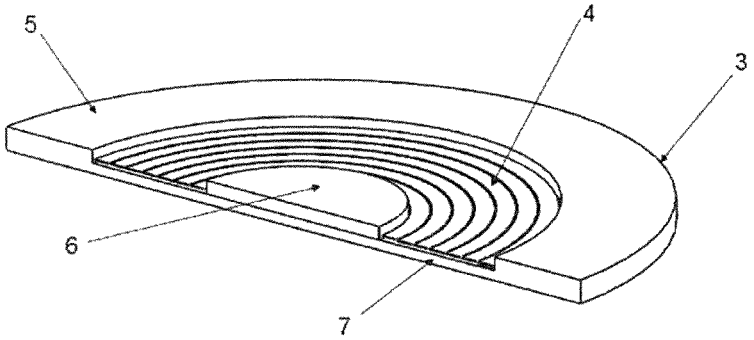
FIG. 6 shows a cross section of the primary side 3 of the magnetic structure of FIG. 5.

FIG. 6 shows a cross section of the primary side 3 of the magnetic structure. The novelty is the appearance of the magnetic outer edge 5. The ideal path of the magnetic field will be from the central primary post 6, through the air gap, through the central post of the secondary through the magnetic plate, through the secondary outer edge, through the air gap, through the primary magnetic edge 5, through the primary magnetic plate 7 and back through primary central post 6. This field lines path is followed by the desired magnetic mutual lines which form the mutual inductance.

The leakage lines path is from primary center post 6 through the air spaces between the primary turns 7, through the primary magnetic plate 7 and back through the central primary post 6. As a result the magnetic field lines are perpendicular to the copper and create high AC proximity effects in the windings.

The magnetic outer edge 5 has several advantages: it increases the primary inductance due to the increase in the total magnetic material size, it forces the leakage magnetic lines to be parallel with the winding and as a result reducing the winding's AC losses.

Second Embodiment

Figure 7:
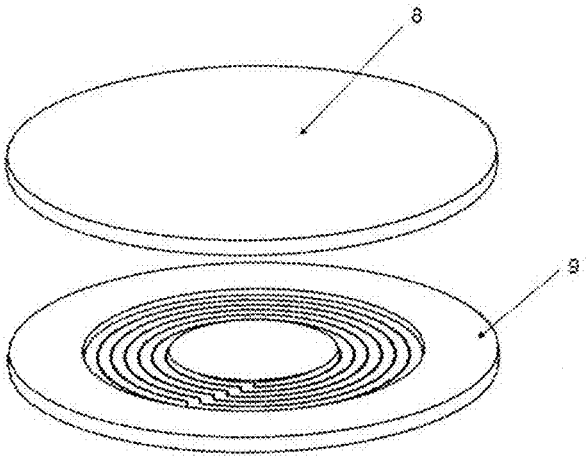
FIG. 7 shows a second magnetic structure according to the present invention.

FIG. 7 shows a second magnetic structure according to the present invention. It comprises of a primary side 9 and a secondary side 8 which are identical in form and size. The primary and secondary include magnetic material and conductive windings. The windings can be made of regular copper wire or litz wire or they can be planar. Also the shape of the wire can be circular or rectangular. In the case of the planar winding configuration, the planar winding width can be designed with constant width per each turn or with a variable width per each turn.

Figure 8:
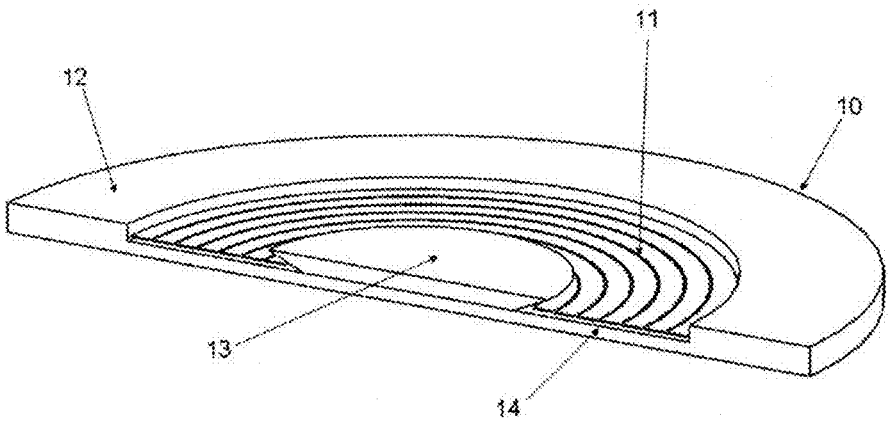
FIG. 8 shows a cross section of the primary side 10 of the magnetic structure of FIG. 7.

FIG. 8 shows a cross section of the primary side 10 of the magnetic structure. The novelty is that the center post has an inverted trapezoidal shape or a hat shape. As a result, the winding is better shielded from the magnetic field. The leakage magnetic field becomes parallel with the winding. The reluctance between the center post 13 and the outer magnetic edge is decreased and more of the magnetic field lines are parallel with the winding.

The ideal path of the magnetic field is from primary center post 13 through the air gap, through the secondary center post, through the secondary magnetic plate, through the secondary magnetic edges, through the air gap, through the primary outer edges 12, through the primary magnetic plate 14, and back through the primary center post 13.

The area of the center post increases, the air gap reluctance is decreased. This compensates for the decrease of distance between the center post 13 and the outer edge 12 which is a leakage line path.

The trapezoidal hat concept can be applied to a variety of magnetic core shapes and can be combined with all the concepts presented in the current invention.

Third Embodiment

Figure 9:
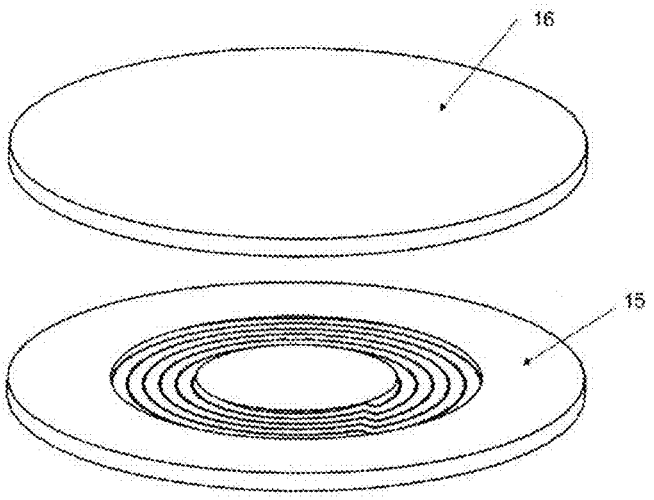
FIG. 9 shows a third magnetic structure according to the present invention.

FIG. 9 shows a third magnetic structure according to the present invention. It comprises of a primary side 15 and a secondary side 16 which are identical in form and size. The primary and secondary include magnetic material and conductive windings. The windings can be made of regular copper wire or litz wire or they can be planar. Also the shape of the wire can be circular or rectangular. In the case of the planar winding configuration, the planar winding width can be designed with constant width per each turn or with a variable width per each turn.

Figure 10:
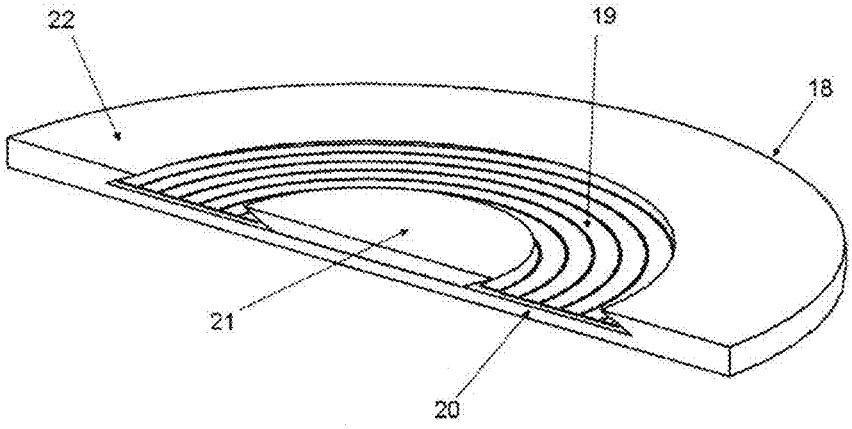
FIG. 10 shows a cross section of the primary side 18 of the magnetic structure of FIG. 9.

FIG. 10 shows a cross section of the primary side 18 of the magnetic structure. The novelty is that the center post has an inverted trapezoidal shape or a hat shape and the outer magnetic edge 22 has also a trapezoidal shape. As a result, the winding is better shielded from the magnetic field. The leakage magnetic field becomes parallel with the winding. The reluctance between the center post 21 and the outer magnetic edge 22 is decreased and more of the magnetic field lines are parallel with the winding.

The ideal path of the magnetic field is from primary center post 21 through the air gap, through the secondary center post, through the secondary magnetic plate, through the secondary magnetic edges, through the air gap, through the primary outer edges 22, through the primary magnetic plate 20, and back through the primary center post 21.

The area of the center post increases, the air gap reluctance is decreased. This compensates for the decrease of distance between the center post 21 and the outer edge 22 which is a leakage line path.

The trapezoidal hat concept can be applied to a variety of magnetic core shapes and can be combined with all the concepts presented in the current invention.

Fourth Embodiment

Figure 11:
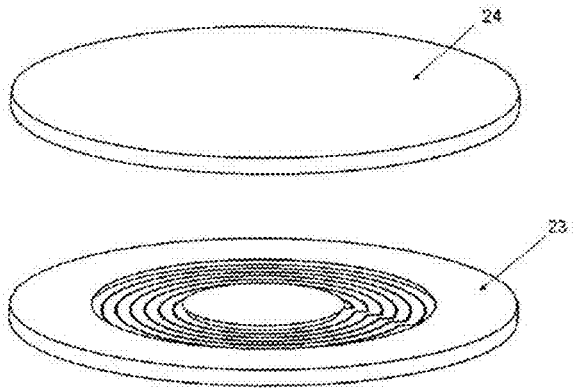
FIG. 11 shows a fourth magnetic structure according to the present invention.

FIG. 11 shows a fourth magnetic structure according to the present invention. It comprises of a primary side 23 and a secondary side 24 which are identical in form and size. The primary and secondary include magnetic material and conductive windings. The windings can be made of regular copper wire or litz wire or they can be planar. Also the shape of the wire can be circular or rectangular. In the case of the planar winding configuration, the planar winding width can be designed with constant width per each turn or with a variable width per each turn.

Figure 12:
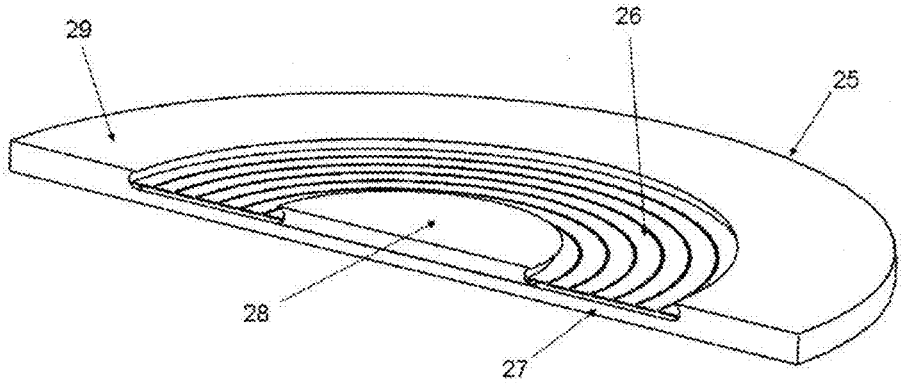
FIG. 12 shows a cross section of the primary side 25 of the magnetic structure of FIG. 11.

FIG. 12 shows a cross section of the primary side 25 of the magnetic structure. The novelty is that the center post 28 has an inverted trapezoidal shape with rounded corners and the outer magnetic edge 29 has also a trapezoidal shape with round corners. As a result, the winding is better shielded from the magnetic field, The leakage magnetic field becomes parallel with the winding. The reluctance between the center post 28 and the outer magnetic edge 29 is decreased and more of the magnetic field lines are parallel with the winding.

The ideal path of the magnetic field is from primary center post 28 through the air gap, through the secondary center post, through the secondary magnetic plate, through the secondary magnetic edges, through the air gap, through the primary outer edges 29, through the primary magnetic plate 27, and back through the primary center post 28.

The area of the center post increases, the air gap reluctance is decreased. This compensates for the decrease of distance between the center post 28 and the outer edge 29 which is a leakage line path.

The trapezoidal hat concept with rounded corners can be applied to a variety of magnetic core shapes and can be combined with all the concepts presented in the current invention.

Fifth Embodiment

Figure 13:
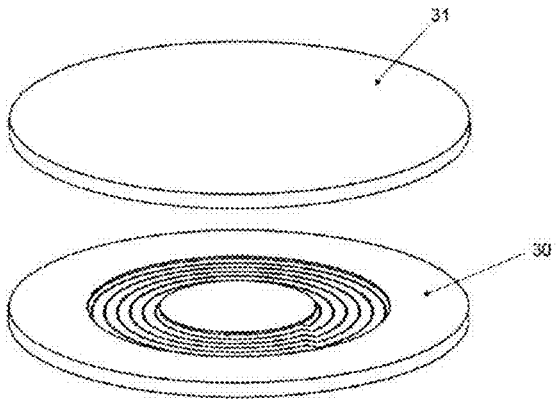
FIG. 13 shows a fifth magnetic structure according to the present invention.

FIG. 13 shows a fifth magnetic structure according to the present invention. It comprises of a primary side 30 and a secondary side 31 which are identical in form and size. The primary and secondary include magnetic material and conductive windings. The windings can be made of regular copper wire or litz wire or they can be planar. Also the shape of the wire can be circular or rectangular. In the case of the planar winding configuration, the planar winding width can be designed with constant width per each turn or with a variable width per each turn.

Figure 14:
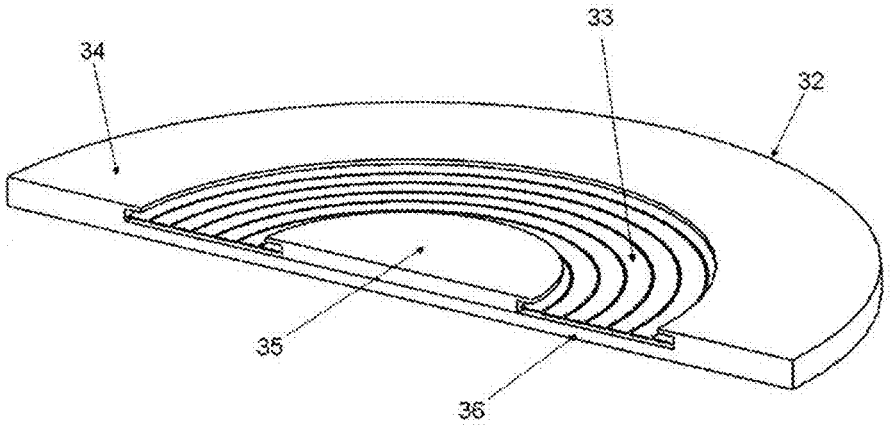
FIG. 14 shows a cross section of the primary side 32 of the magnetic structure of FIG. 13.

FIG. 14 shows a cross section of the primary side 32 of the magnetic structure. The novelty is that the center post 35 has a t-shape and the outer magnetic edge 34 has also a t-shape. As a result, the winding is better shielded from the magnetic field. The leakage magnetic field becomes parallel with the winding. The reluctance between the center post 35 and the outer magnetic edge 34 is decreased and more of the magnetic field lines are parallel with the winding.

The ideal path of the magnetic field is from primary center post 235 through the air gap, through the secondary center post, through the secondary magnetic plate, through the secondary magnetic edges, through the air gap, through the primary outer edges 34, through the primary magnetic plate 36, and hack through the primary center post 35.

The area of the center post increases, the air gap reluctance is decreased. This compensates for the decrease of distance between the center post 35 and the outer edge 34 which is a leakage line path.

The t-shape hat concept can be applied to a variety of magnetic core shapes, and can be combined with all the concepts presented in the current invention.

Sixth Embodiment

Figure 15:
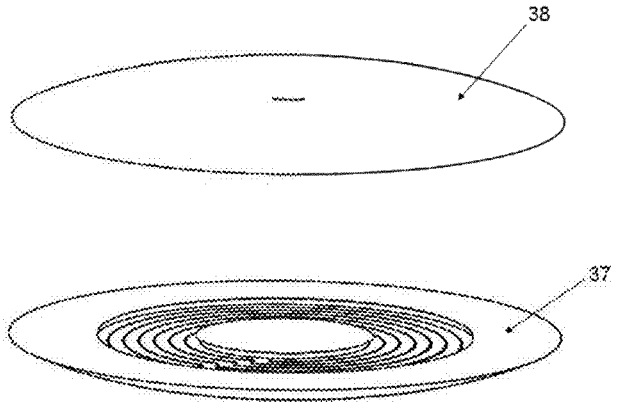
FIG. 15 shows a sixth magnetic structure according to the present invention.

FIG. 15 shows a sixth magnetic structure according to the present invention. It comprises of a primary side 37 and a secondary side 38 which are identical in form and size. The primary and secondary include magnetic material and conductive windings. The windings can be made of regular copper wire or litz wire or they can be planar. Also the shape of the wire can be circular or rectangular. In the case of the planar winding configuration, the planar winding width can be designed with constant width per each turn or with a variable width per each turn.

Figure 16:
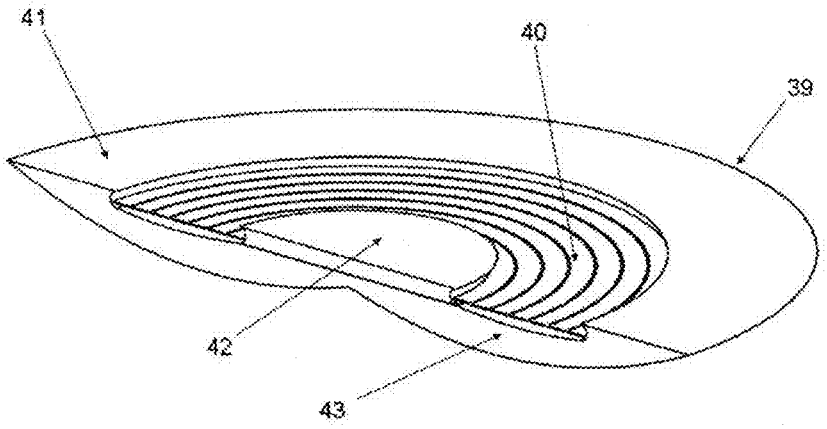
FIG. 16 shows a cross section of the primary side 39 of the magnetic structure of FIG. 15.

FIG. 16 shows a cross section of the primary side 39 of the magnetic structure. The novelty is that the center post 42 has an inverted trapezoidal shape with rounded corners and the outer magnetic edge 41 has also an inverted trapezoidal shape with rounded corners. Also the ferrite base 43 has cuts in such way that it's magnetic reluctance is minimized. AS a result, the winding is better shielded from the magnetic field. The leakage magnetic field becomes parallel with the winding. The reluctance between the center post 42 and the outer magnetic edge 41 is decreased and more of the magnetic field lines are parallel with the winding.

The ideal path of the magnetic field is from primary center post 42 through the air gap, through the secondary center post, through the secondary magnetic plate, through the secondary magnetic edges, through the air gap, through the primary outer edges 41, through the primary magnetic plate 43, and back through the primary center post 42.

The area of the center post increases, the air gap reluctance is decreased. This compensates for the decrease of distance between the center post 42 and the outer edge 41 which is a leakage line path.

The trapezoidal shape with rounded corners and ferrite cuts concept can be applied to a variety of magnetic core shapes and can be combined with all the concepts presented in the current invention.

SUMMARY

Thus, as seen from the foregoing description, one feature of the present invention is that the magnetic structures are configured to help minimize the winding's AC losses, improving the system's efficiency. Another feature is that the combination of different magnetic hats creates a shaping path for the magnetic field. Still another feature is that the magnetic hat concept can be applied to a variety of magnetic core shapes.

REFERENCES

[1] Budhia, M. Boys, Covic, "Design and optimisation of Circular Magnetic Structures for Lumped Inductive Power Transfer Systems", Power Electronics, IEEE Transactions on, Volume: 26, Issue: 11, Publication Year: 2011, Page(s): 3096-3108.

[2] US PATENT 20110254377A1.

[3] John M. Miller, Matthew B. Scudiere, John W. McKeever, Cliff White, "Wireless Power Transfer" Oak Ridge National Laboratory's Power Electronics Symposium Tennessee,

[4] A. E. Umenei, J. Schwannecke, S. Velpula, D. Baarman, "Novel Method for Selective Non-linear Fluxguide Switching for Contactless Inductive Power Transfer", Fulton Innovation, Ada Mich., USA.

The invention claimed is:

1. A circular magnetic structure comprising:

a magnetic core made of solid magnetic material comprising:

a magnetic plate having an inner portion and an outer portion, said outer portion defining outer periphery of the magnetic core and said inner portion defining inner periphery of the magnetic core, an outer edge having a bottom surface disposed on the outer portion of the magnetic plate and a top surface elevated from the inner portion of the magnetic plate;

a post made of said solid magnetic material having a bottom surface disposed within the inner portion of the magnetic plate at a distance from the outer edge and a top surface elevated from the inner portion of the magnet plate; wherein either the top surface of the post or the top surface of the outer edge or the top surface of the post and the top surface of the outer edge is larger than the bottom surface of the post or the bottom surface of outer edge respectively such that, when one or more conductive windings are disposed between the post and the outer edge, the distance between the post and the outer edge comprises a magnetic leakage line path that is in parallel with the one or more conductive windings.

2. The magnetic structure in claim 1, wherein the post is positioned at the center of the inner portion of the magnetic plate.

3. The magnetic structure in claim 1, wherein the post has a shape of solid cylinder.

4. The magnetic structure in claim 1, wherein a cross section of the post has an inverted trapezoidal shape.

5. The magnetic structure in claim 1, wherein a cross section of the post has a hat shape.

6. The magnetic structure in claim 1, wherein a cross section of the center post has a t-shape.

7. The magnetic structure in claim 1, wherein a cross section of the outer edge has an inverted trapezoidal shape.

8. The magnetic structure in claim 1, wherein a cross section of the outer edge has a hat shape.

9. The magnetic structure in claim 1, wherein a cross section of the outer edge has a t-shape.

10. The magnetic structure in claim 1, wherein the conductive winding comprises a regular copper wire or litz wire.

11. The magnetic structure in claim 1, wherein the conductive winding comprises a planar winding configuration.

12. The magnetic structure in claim 11, wherein the planar winding configuration has a constant width per each turn.

13. The magnetic structure in claim 11, wherein the planar winding configuration has a variable width per each turn.

14. A transformer comprising:

circular primary and circular secondary magnetic cores made of solid magnetic material, each one of the primary and secondary magnetic cores comprising:

a magnetic plate having an inner portion and an outer portion, said outer portion defining outer periphery of the magnetic core and said inner portion defining inner periphery of the magnetic core, an outer edge having a bottom surface disposed on the outer portion of the magnetic plate a top surface that is elevated from the inner portion of the magnetic plate;

a post having a bottom surface disposed within the inner portion of the magnetic plate at a distance from the outer edge and a top surface that is elevated from the inner portion of the magnet plate; and wherein either the top surface of the post of the primary magnetic core or the top surface of the outer edge of the primary magnetic core or the top surface of the post of the primary magnetic core and the top surface of the outer edge of the primary magnetic core is larger than the bottom surface of the post of the primary magnetic core or the bottom surface of the outer edge of the primary magnetic core respectively such that, when one or more primary conductive windings are disposed between the post and the outer edge of the primary magnetic core, the distance between the post and the outer edge of the primary magnetic core comprises a primary magnetic leakage line path that is in parallel with the one or more primary conductive windings; and wherein either the top surface of the post of the secondary magnetic core or the top surface of the outer edge of the secondary magnetic core or the top surface of the post of the secondary magnetic core and the to surface of the outer edge of the secondary magnetic core is larger than the bottom surface of the post of the secondary magnetic core or the bottom surface of the outer edge of the secondary magnetic core respectively such that, when one or more secondary conductive windings are disposed between the post and the outer edge of the secondary magnetic core, the distance between the post and the outer edge of the secondary magnetic core comprises a magnetic leakage line path that is in parallel with the one or more secondary conductive windings.

15. The transformer of claim 14, wherein the primary and secondary magnetic cores are positioned opposite each other with their corresponding top surface of their corresponding posts facing each other.

16. The transformer of claim 15, wherein there is an air gap between the primary and secondary magnetic cores.

* * * * *